US008912964B2

(12) United States Patent
Hijirikawa

(10) Patent No.: US 8,912,964 B2
(45) Date of Patent: Dec. 16, 2014

(54) VEHICLE-MOUNTED ANTENNA SUBSTRATE UNIT

(71) Applicant: Kojima Press Industry Co., Ltd., Toyota-shi, Aichi-ken (JP)

(72) Inventor: Kei Hijirikawa, Toyota (JP)

(73) Assignee: Kojima Press Industry Co., Ltd., Toyota-Shi, Aichi-Ken (JP)

( * ) Notice: Subject to any disclaimer, the term of this patent is extended or adjusted under 35 U.S.C. 154(b) by 188 days.

(21) Appl. No.: 13/758,495

(22) Filed: Feb. 4, 2013

(65) Prior Publication Data

US 2013/0249747 A1 Sep. 26, 2013

(30) Foreign Application Priority Data

Mar. 23, 2012 (JP) ..... 2012-067671

(51) Int. Cl.
*H01Q 1/32* (2006.01)

(52) U.S. Cl.
CPC ..... *H01Q 1/3216* (2013.01); *H01Q 1/32* (2013.01)
USPC ..... 343/712; 343/713

(58) Field of Classification Search
CPC ..... H01Q 1/32; H01Q 1/325; H01Q 1/3216
USPC ..... 343/711, 712, 713
See application file for complete search history.

(56) References Cited

U.S. PATENT DOCUMENTS

| | | | | |
|---|---|---|---|---|
| 5,959,581 | A * | 9/1999 | Fusinski | 343/700 MS |
| 2006/0109178 | A1 | 5/2006 | Takeuchi et al. | |
| 2008/0218422 | A1 | 9/2008 | Lindenmeier et al. | |

FOREIGN PATENT DOCUMENTS

| | | | |
|---|---|---|---|
| EP | 0 899 810 | A2 | 3/1999 |
| EP | 1 968 156 | A1 | 9/2008 |
| JP | 2007-104560 | A | 4/2007 |
| JP | 2008283609 | | 11/2008 |
| JP | 2009177484 | | 8/2009 |

OTHER PUBLICATIONS

European Search Report for European Application No. 13000610.9 dated May 6, 2013.

* cited by examiner

*Primary Examiner* — Robert Karacsony
(74) *Attorney, Agent, or Firm* — Muncy, Geissler, Olds & Lowe, P.C.

(57) ABSTRACT

The present invention is directed to achieving a favorable grounding state in a vehicle-mounted antenna. One end of a bent antenna element 22 is connected to an inner conductor of a coaxial cable 14 via a wiring conductor pattern of a substrate 12. An outer conductor of the coaxial cable 14 is connected to a front grounding conductor pattern of the substrate 12. In the substrate 12, a plate capacitor is formed by the front grounding conductor pattern, a rear grounding conductor pattern, and a dielectric plate sandwiched between these grounding conductor patterns. The outer conductor 52 of the coaxial cable 14 is electrically connected to one end of a grounding bracket 20 via the plate capacitor. A tip portion 24 of the grounding bracket 20 is secured to a vehicle body by means of a bolt 26 and is electrically connected to the vehicle body.

9 Claims, 12 Drawing Sheets

VEHICLE-MOUNTED ANTENNA SUBSTRATE UNIT

PRIORITY INFORMATION

This application claims priority to Japanese Patent Application No. 2012-067671, filed on Mar. 23, 2012, which is incorporated herein by reference in its entirety.

BACKGROUND OF THE INVENTION

1. Field of the Invention

The present invention relates to a vehicle-mounted antenna substrate unit, and particularly to an antenna grounding structure.

2. Description of Related Art

Pole antennas are widely used as vehicle-mounted antennas. A pole antenna is a rod-shaped antenna that is secured to a vehicle body in an upright position. As a pole antenna protrudes from the vehicle, it serves as a component that contributes to the appearance of the vehicle. However, there are users who prefer a design in which no antenna shows in the external appearance of the vehicle.

Accordingly, in addition to pole antennas, spoiler antennas formed by providing an antenna element inside a spoiler are also widely used. A spoiler is a member attached to a vehicle body for adjusting air flow, and is also a member that contributes to the appearance of the vehicle. A spoiler may be a visor-shaped member provided at the upper part of the rear window of the vehicle, or may be a wing-shaped member provided at the rear part of the vehicle. JP 2009-177484 A and JP 2008-283609 A disclose vehicle-mounted spoiler antennas as related art of the present invention.

In general, a pole antenna secured to a vehicle body in an upright position comprises a monopole antenna having an electrical length of one quarter wavelength. In such cases, the vehicle body functions as a grounding conductor and serves as one element for exhibiting antenna performance.

Further, in a spoiler antenna, when a conductor wire having an electrical length of one quarter wavelength is used as the antenna element and a coaxial cable is used as the power feed line, the outer conductor of the coaxial cable is connected to the vehicle body at an end connected to the antenna element. In this case too, the vehicle body functions as a grounding conductor and serves as one element for exhibiting antenna performance.

However, a spoiler is formed using a non-conductive material such as plastic resin. For this reason, the grounding path from the spoiler antenna to the vehicle body may become long, resulting in it being impossible to exhibit sufficient spoiler antenna performance.

SUMMARY OF THE INVENTION

An object of the present invention is to achieve a favorable grounding state in a vehicle-mounted antenna.

According to one aspect of the present invention, a vehicle-mounted antenna substrate unit comprises a substrate having an antenna element connected thereto and including a grounding conductor plate, a linear conductor drawn out from the substrate and at least partly secured to a conductor component of a vehicle, and a capacitor provided between the grounding conductor plate and the linear conductor.

Preferably, in the vehicle-mounted antenna substrate unit according to the present invention, the capacitor comprises the grounding conductor plate and a further layer conductor plate provided in a layer different from the layer in which the grounding conductor plate is provided, and the linear conductor is connected to the further layer conductor plate.

Preferably, the vehicle-mounted antenna substrate unit according to the present invention includes a cable drawn out from the substrate, as well as an impedance matching circuit provided on the substrate and between the antenna element and the cable, and the impedance matching circuit comprises the capacitor.

Preferably, in the vehicle-mounted antenna substrate unit according to the present invention, the capacitor comprises the grounding conductor plate and a further layer conductor plate provided in a layer different from the layer in which the grounding conductor plate is provided, and the linear conductor is connected to the further layer conductor plate.

Preferably, in the vehicle-mounted antenna substrate unit according to the present invention, the linear conductor is formed to have a belt shape and has a tip portion secured to the vehicle.

Preferably, the vehicle-mounted antenna substrate unit according to the present invention includes an antenna base on which the substrate and the linear conductor are arranged, and the antenna base is secured to an exterior component of the vehicle.

Preferably, in the vehicle-mounted antenna substrate unit according to the present invention, the above-noted conductor component is a body of the vehicle, and the exterior component is a spoiler.

Preferably, in the vehicle-mounted antenna substrate unit according to the present invention, the above-noted conductor component is a body of the vehicle, and the substrate and the linear conductor are provided on a non-conductive exterior component of the vehicle. Further, the linear conductor is secured to the vehicle body together with the exterior component by means of a member that fastens the exterior component to the vehicle body.

According to the present invention, a favorable grounding state of a vehicle-mounted antenna can be attained.

DETAILED DESCRIPTION OF THE INVENTION

Figure 1:
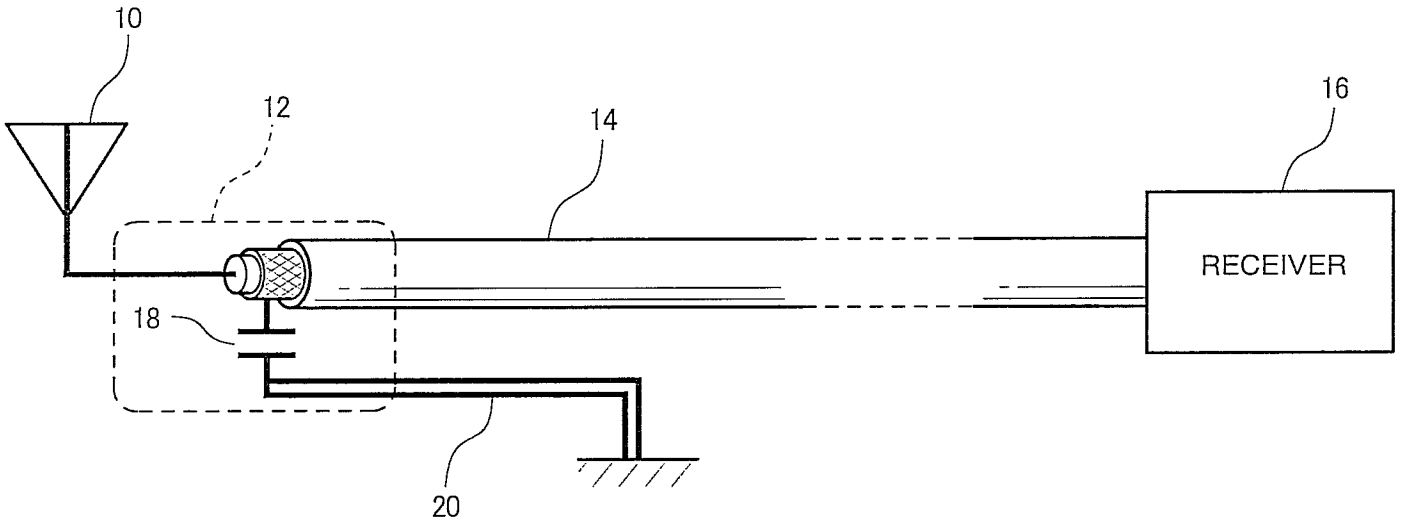
FIG. 1 is a schematic view showing a vehicle-mounted antenna according to the present invention.

FIG. 1 schematically shows a vehicle-mounted antenna according to an embodiment of the present invention. The vehicle-mounted antenna includes an antenna element 10, substrate 12, coaxial cable 14, capacitor 18, and grounding bracket 20.

As the antenna element 10, an element that operates in an unbalanced mode is used, such as a quarter-wavelength linear antenna element. The antenna element 10 is connected to an inner conductor of the coaxial cable 14 via the substrate 12. The coaxial cable 14 is drawn out from the substrate 12 and connected to a receiver 16 mounted on the vehicle. At an end located on the side of the antenna element 10, the outer conductor of the coaxial cable 14 is connected to a first terminal of the capacitor 18 provided on the substrate 12. The other terminal of the capacitor 18 is connected via the grounding bracket 20 to a conductor component of the vehicle, which serves as a grounding conductor. While the conductor component of the vehicle may be the body, chassis, or other parts, the following description is given assuming that the conductor component is the vehicle body.

Figure 2:
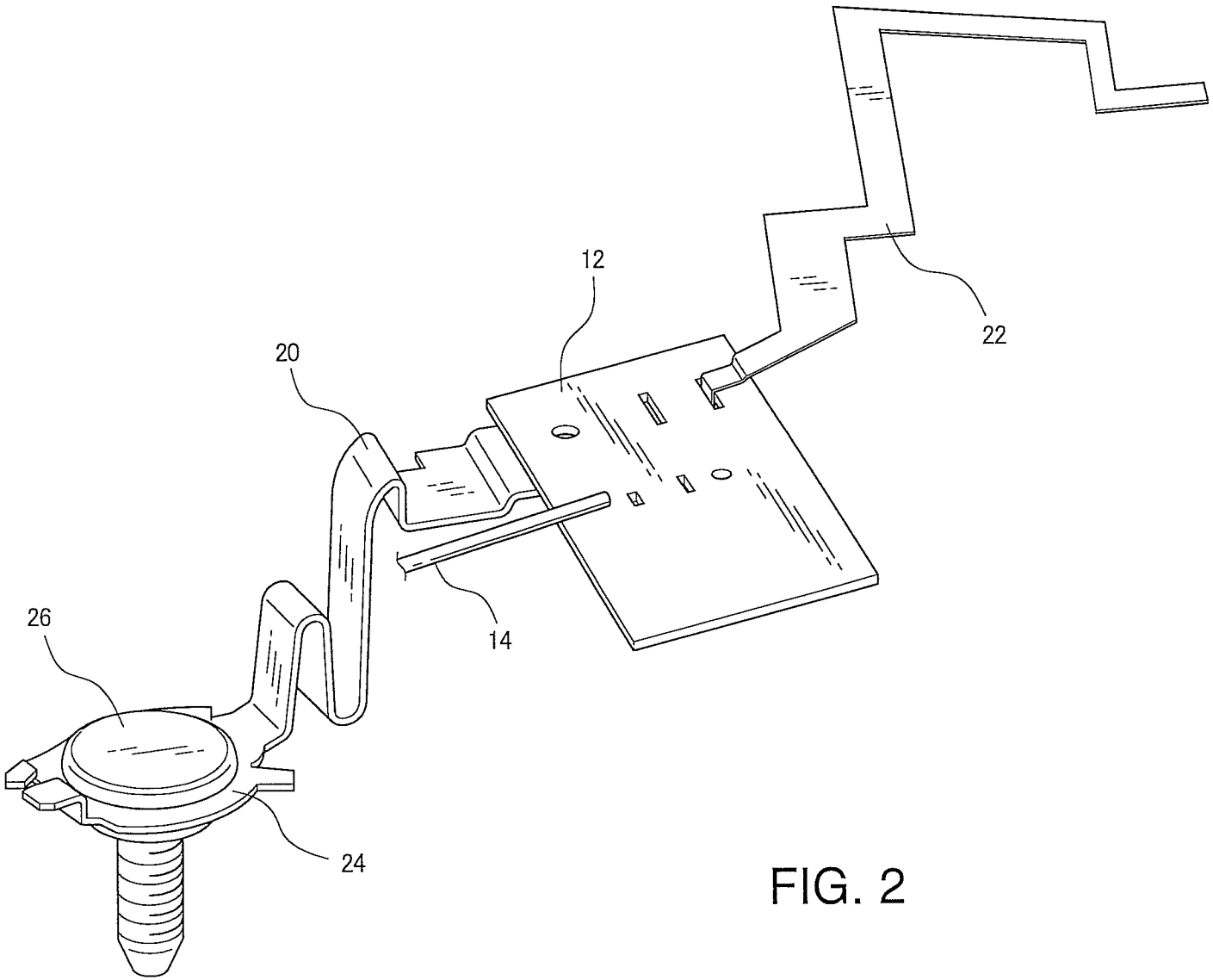
FIG. 2 is a perspective view showing an example configuration of a vehicle-mounted antenna.

FIG. 2 is a perspective view showing an example configuration of a vehicle-mounted antenna. In this example configuration, a bent antenna element 22 is employed as the antenna element, and the capacitor is formed using the substrate 12 having a multi-layered structure. The bent antenna element 22 has a plurality of bent portions between one end to the other end, and has an electrical length of approximately one quarter wavelength. As an alternative to the bent antenna element 22, it is also possible to employ, as the antenna element, a straight or curved element having an electrical length of approximately one quarter wavelength. One end of the bent antenna element 22 is connected to a wiring conductor pattern on the substrate 12. The inner conductor of the coaxial cable 14 is also connected to the wiring conductor pattern on the substrate 12. In other words, one end of the bent antenna element 22 is connected to the inner conductor of the coaxial cable 14 via the wiring conductor pattern. Further, the outer conductor of the coaxial cable 14 is connected to a grounding conductor pattern on the substrate 12.

The grounding bracket 20 is formed of a linearly extending conductor and is drawn out from the substrate 12. In the example shown in FIG. 2, the grounding bracket 20 is belt-shaped and is bent in a meandering manner. A tip portion 24 widened in a flat plate shape has a bolt hole formed therein, and a bolt 26 is placed through this bolt hole. The tip portion 24 of the grounding bracket 20 is secured to the vehicle by the bolt 26.

By configuring the grounding bracket 20 to have a belt shape and to be bent in a meandering manner, it is possible to prevent a large force from being applied to the joint portion between the grounding bracket 20 and the substrate 12. Further, depending on the material and structure of the grounding bracket 20, the position of the tip portion 24 can be changed while the end of the grounding bracket 20 on the substrate 12 side is fixed. With this arrangement, the degree of freedom of the position for securing the tip portion 24 is increased, which facilitates securing of the grounding bracket 20. The grounding bracket 20 may alternatively have a linear shape, which allows freedom in deciding the position of the tip portion 24.

Figure 3:
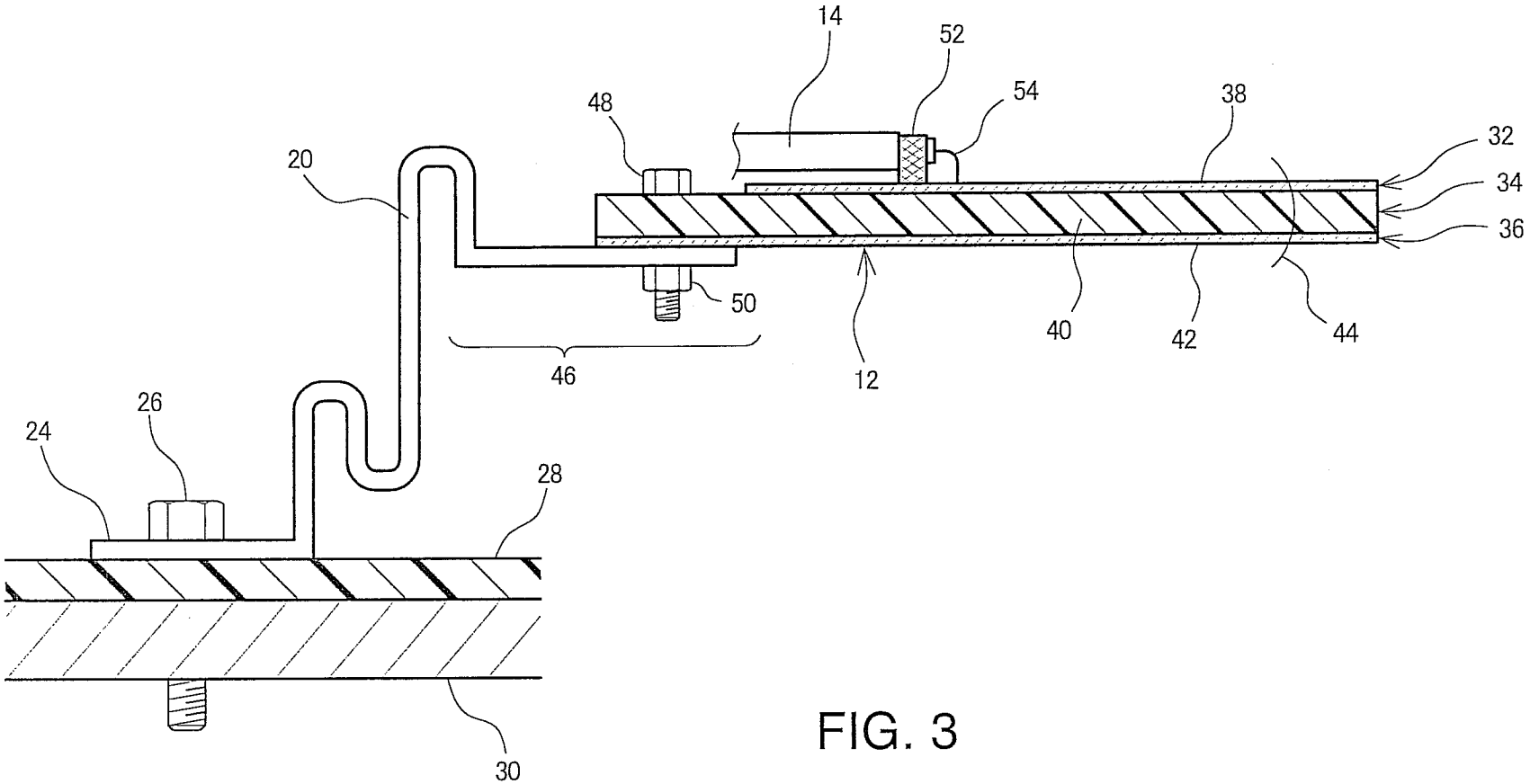
FIG. 3 is a schematic view showing a configuration of an antenna substrate unit.

FIG. 3 schematically shows a structure of an antenna substrate unit comprising the substrate 12, coaxial cable 14, and grounding bracket 20. The elements identical to those in FIG. 2 are labeled with the same numerals, and explanations thereof are not repeated. FIG. 3 shows the tip portion 24 of the grounding bracket 20 being secured to a vehicle body 30 together with a vehicle component 28 made of plastic resin. The vehicle component 28 may be a plate used for the interior of the vehicle, a spoiler, a bumper, or the like.

The substrate 12 is composed of a front surface layer 32, intermediate layer 34, and a rear surface layer 36. The front surface layer 32 is provided with a wiring conductor pattern, and also a front grounding conductor pattern 38 functioning as a grounding conductor plate. The intermediate layer 34 is made of a dielectric material and forms a dielectric plate 40. The rear surface layer 36 is provided with a rear grounding conductor pattern 42 functioning as a grounding conductor plate. The front grounding conductor pattern 38 and the rear grounding conductor pattern 42 sandwich the dielectric plate 40, thereby forming a plate capacitor 44.

The substrate 12 has a bolt hole formed therein. In the example shown in FIG. 3, the portion at which this bolt hole is formed is a portion at which the front grounding conductor pattern 38 opposite to the rear grounding conductor pattern 42 is not provided. A bolt hole is also formed in a straight portion 46 of the grounding bracket 20 on the substrate 12 side. The straight portion 46 of the grounding bracket 20 is overlapped on the rear grounding conductor pattern 42, with the bolt hole in the straight portion 46 being aligned with the bolt hole in the substrate 12. A bolt 48 is placed through the bolt holes, and a nut 50 is tightened thereon so as to join the grounding bracket 20 and the substrate 12.

While the above description refers to a structure in which the grounding bracket 20 is secured to the substrate 12 using the bolt 48 and the nut 50, other structures are also possible. For example, the use of the nut 50 may be eliminated by providing threads in the bolt hole formed in the grounding bracket 20.

Figure 4:
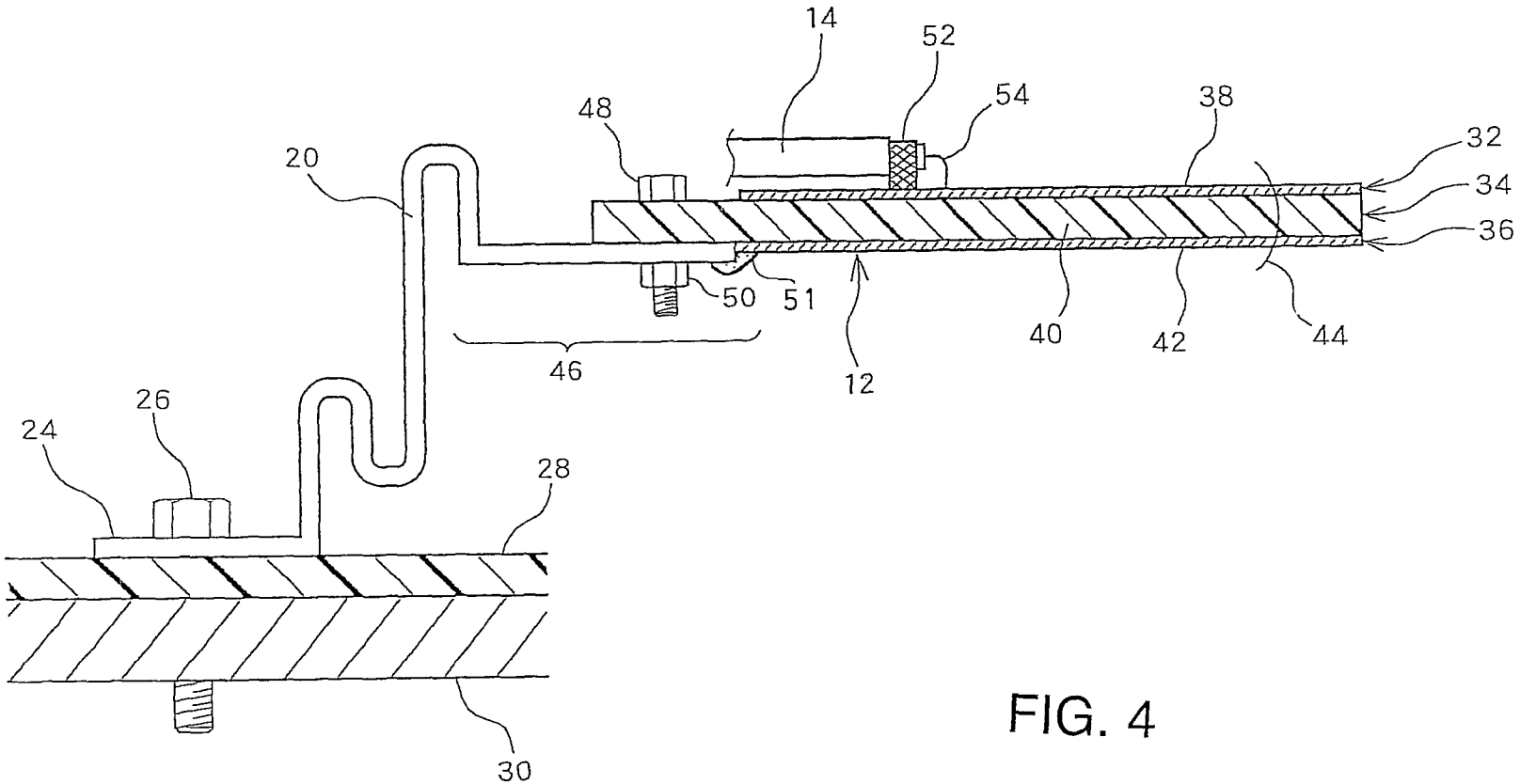
FIG. 4 is a schematic view showing another example configuration of an antenna substrate unit.

Further, while the above description refers to a structure in which the straight portion 46 of the grounding bracket 20 is overlapped on the rear grounding conductor pattern 42, other structures are also possible. For example, as shown in FIG. 4, it may be configured such that the rear grounding conductor pattern 42 is not located in the region of the substrate 12 on which the straight portion 46 of the grounding bracket 20 is overlapped. In that case, the straight portion 46 of the grounding bracket 20 directly contacts the rear surface of the dielectric plate 40. Further, the rear grounding conductor pattern 42 is formed such that its edge is located very close to an edge of the straight portion 46, and the rear grounding conductor pattern 42 and the straight portion 46 are electrically connected to each other by soldering or the like. In the example shown in FIG. 4, the right end of the straight portion 46 is connected with the left end edge of the rear grounding conductor pattern 42 by solder 51.

The vehicle body 30 has a threaded bolt hole formed therein. The vehicle component 28 is placed on the vehicle body 30, with the bolt hole of the vehicle component 28 being aligned with the bolt hole of the vehicle body 30. In turn, the tip portion 24 of the grounding bracket 20 is placed on the vehicle component 28, with the bolt hole of the tip portion 24 being aligned with the respective bolt holes of the vehicle component 28 and the vehicle body 30. While in that state, a bolt 26 is placed through the bolt holes formed in the tip portion 24 of the grounding bracket 20 and the vehicle component 28, and is screwed into the vehicle body 30, so that the tip portion 24 of the grounding bracket 20, the vehicle component 28, and the vehicle body 30 are joined together.

Figure 5:
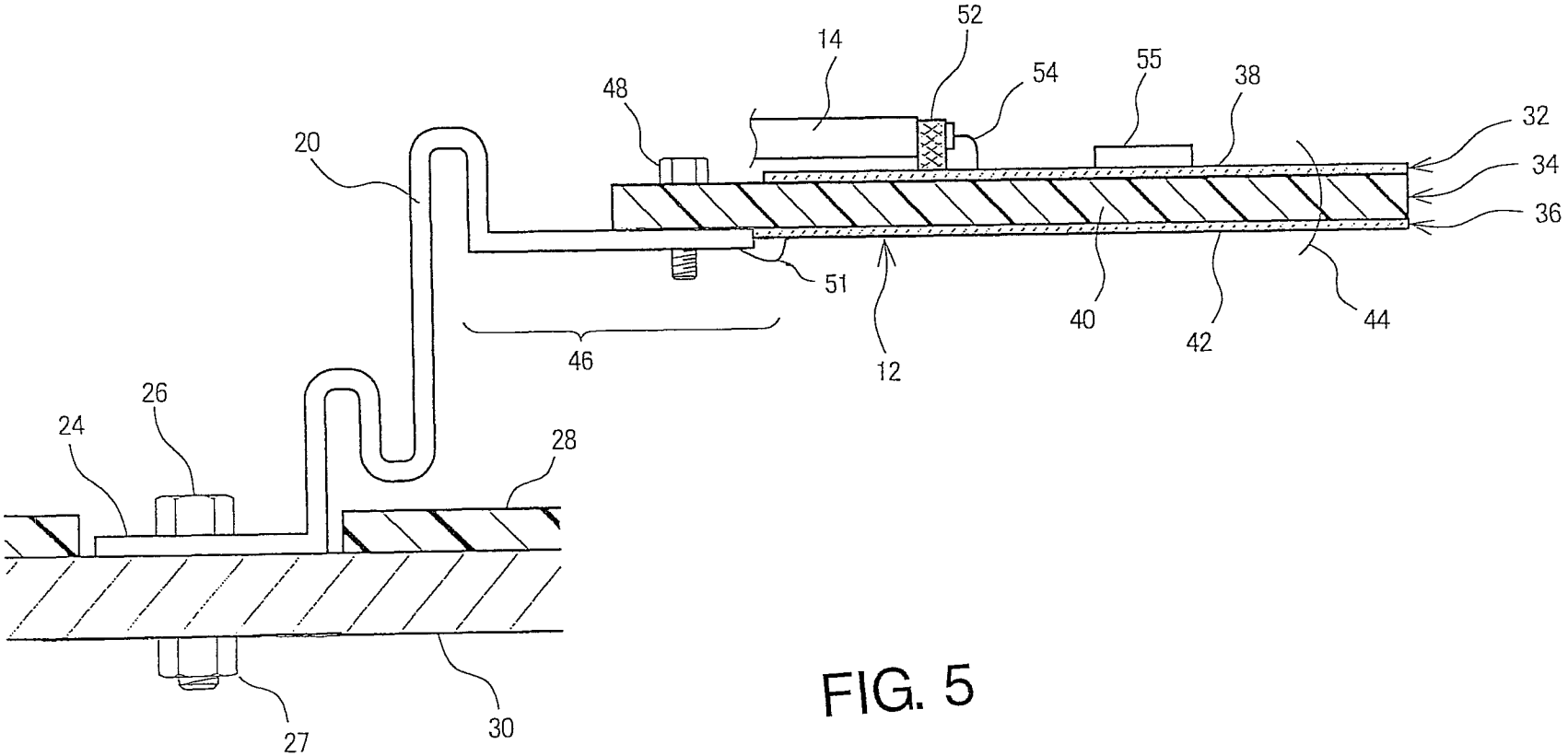
FIG. 5 is a schematic view showing a further example configuration of an antenna substrate unit.

While the above description refers to a case in which the bolt hole of the vehicle body 30 is threaded, it is alternatively possible that the bolt hole of the vehicle body 30 is not provided with threads. In that case, as shown in FIG. 5, a nut 27 may be placed and tightened on the tip of the bolt 26 penetrating through the vehicle body 30. In this case, the bolt 26 may be a member fixed on the tip portion 24 of the grounding bracket 20. Furthermore, as shown in FIG. 5, a configuration is possible in which the bolt hole in the straight portion 46 of the grounding bracket 20 is threaded and the use of the nut is eliminated.

The outer conductor 52 of the coaxial cable 14 is connected to the front grounding conductor pattern 38, while the inner conductor 54 of the coaxial cable 14 is connected to the wiring conductor pattern formed on the front surface layer 32.

According to the above-described arrangement, the outer conductor 52 of the coaxial cable 14 is electrically connected to one end of the grounding bracket 20 via the plate capacitor 44 formed in the substrate 12. Further, the tip portion 24 of the grounding bracket 20 is fastened to the vehicle body 30 together with the vehicle component 28 by means of the bolt 26, and is electrically connected to the vehicle body 30 via the bolt 26.

In general, when an unbalanced-mode antenna element is connected to a coaxial cable, antenna performance is sufficiently exhibited by configuring such that the outer conductor of the coaxial cable is grounded at its end connected to the antenna element. However, when the outer conductor of the coaxial cable is connected to a grounding conductor via a linear conductor like the grounding bracket 20, impedance between the outer conductor of the coaxial cable and the grounding conductor disadvantageously becomes large due to inductance and capacitance of the linear conductor. In such a case, it may not be possible to exhibit sufficient antenna performance due to reasons such as that a common mode current flows in the outer conductor of the coaxial cable.

In the vehicle-mounted antenna according to the present embodiment, the plate capacitor 44 is connected between the outer conductor 52 of the coaxial cable 14 and the grounding bracket 20. With this arrangement, impedance between the outer conductor 52 of the coaxial cable 14 and the vehicle body 30 serving as the grounding conductor becomes reduced, such that the antenna performance becomes enhanced.

Further, as the plate capacitor 44 is formed with the front grounding conductor pattern 38, the dielectric plate 40, and the rear grounding conductor pattern 42, it may be unnecessary to provide a capacitor element separately from the substrate 12, such that the structure of the vehicle-mounted antenna can be simplified.

Moreover, as the structure for fastening the vehicle component 28 is employed for securing the tip portion 24 of the grounding bracket 20, the structure for securing the grounding bracket 20 is thus simplified.

The impedance between the outer conductor 52 of the coaxial cable 14 and the vehicle body 30 becomes minimum when series resonance occurs between the grounding bracket 20 and the plate capacitor 44. In this situation, the structures of the grounding bracket 20 and the plate capacitor 44 may be selected such that the series resonance frequency matches the service frequency.

For example, inductance of the grounding bracket 20 becomes increased as the grounding bracket 20 is formed longer and as its width is made narrower. Further, as the distance between the front grounding conductor pattern 38 and the rear grounding conductor pattern 42 is made smaller and as the dielectric constant of the dielectric plate 40 is made larger, the capacitance becomes increased. Accordingly, the series resonance frequency of the grounding bracket 20 and the plate capacitor 44 may be matched with the service frequency by adjusting the length and width of the grounding bracket 20, the distance between the front grounding conductor pattern 38 and the rear grounding conductor pattern 42, and the dielectric constant of the dielectric plate 40.

Figure 6:
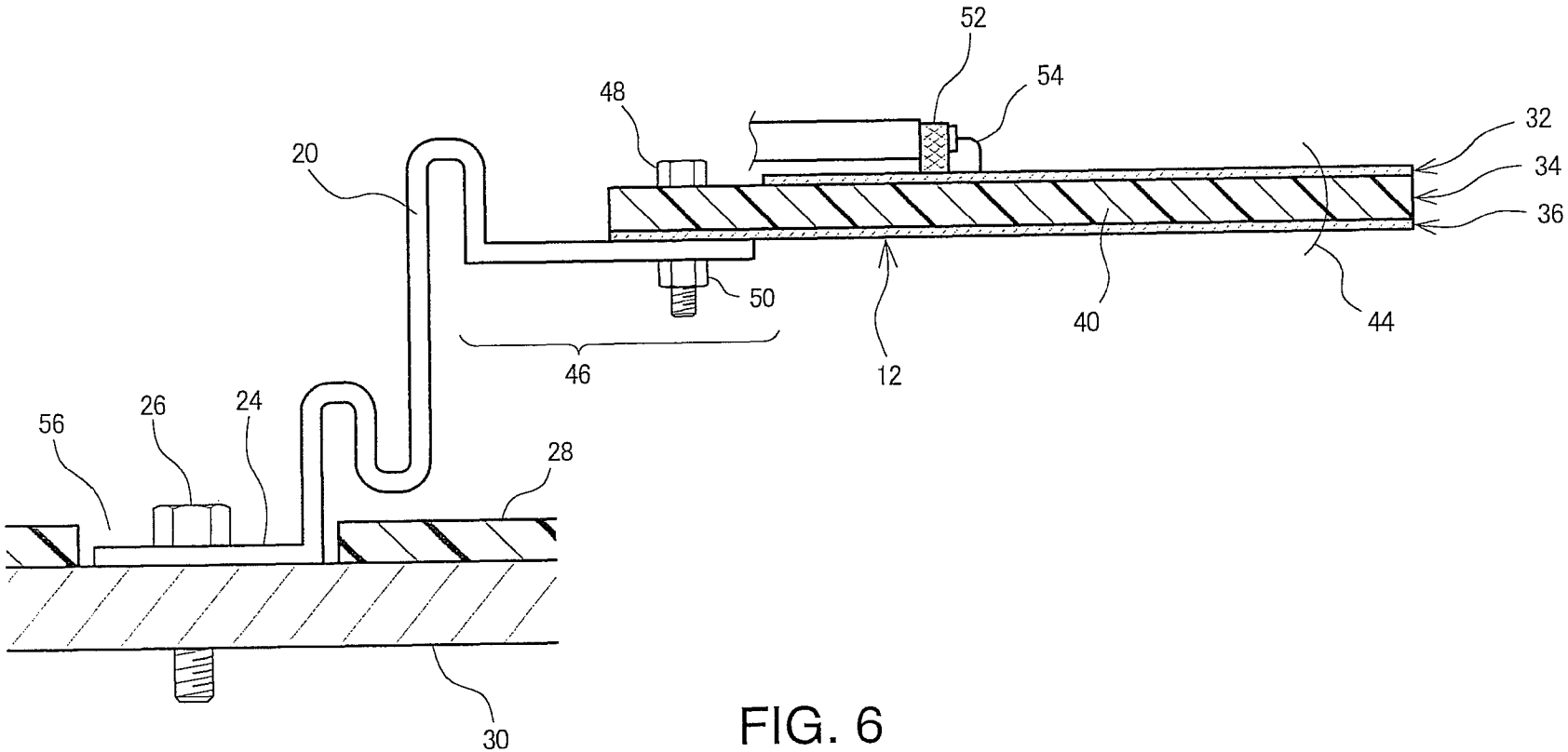
FIG. 6 shows a configuration in which a tip portion of a grounding bracket is directly fastened to a vehicle body.

Further, in order to adjust the impedance between the outer conductor 52 of the coaxial cable 14 and the vehicle body 30, a separate reactance element such as a capacitor or inductor may be connected between the front grounding conductor pattern 38 and the rear grounding conductor pattern 42. Also, instead of directly connecting the grounding bracket 20 and the rear grounding conductor pattern 42 to each other, a reactance element may be placed between these two components. These reactance elements for impedance adjustment may comprise chip components mounted on the substrate 12. The grounding bracket 20 may not necessarily be secured to the vehicle body 30 together with the vehicle component 28. That is, a structure for securing the tip portion 24 of the grounding bracket 20 directly to the vehicle body 30 may alternatively be employed. In that case, as shown in FIG. 6, a bracket tip accommodating hole 56 that is larger than the tip portion 24 of the grounding bracket 20 is formed in the vehicle component 28. The tip portion 24 of the grounding bracket 20 is placed on the vehicle body 30 in direct contact thereto, with the bolt hole in the tip portion 24 being aligned with the bolt hole of the vehicle body 30. Then, the bolt 26 is placed through the bolt hole in the tip portion 24 of the grounding bracket 20 and is screwed into the bolt hole of the vehicle body 30, so that the tip portion 24 of the grounding bracket 20 is secured to the vehicle body 30.

As shown in FIG. 5, an impedance matching circuit 55 may be provided between the bent antenna element 22 and the inner conductor 54 of the coaxial cable 14. In that case, the wiring conductor pattern formed on the front surface layer 32 of the substrate 12 includes a conductor pattern for mounting the impedance matching circuit 55. Furthermore, the capacitance value of the plate capacitor 44 formed in the substrate 12 may be selected such that the plate capacitor 44 functions as an impedance matching element.

While the substrate 12 composed of three layers is described above, the substrate 12 may alternatively be configured with four or more alternately-overlapped dielectric and conductor layers. In that case, the plate capacitor may be formed with two conductor layers sandwiching one dielectric layer. The grounding bracket 20 is connected to a first one of the two conductor layers forming the plate capacitor. Further, the outer conductor 52 of the coaxial cable 14 is connected to the other one of the two conductor layers. The wiring conductor pattern is formed on any one of the conductor layers among the four or more layers.

Next, a spoiler antenna system according to an application example of the present invention is described. The spoiler antenna system described herein is configured by mounting the above-described vehicle-mounted antenna on a spoiler as a DAB (Digital Audio Broadcast) antenna. DAB is a standard for digital radio adopted in many countries.

Figure 7:
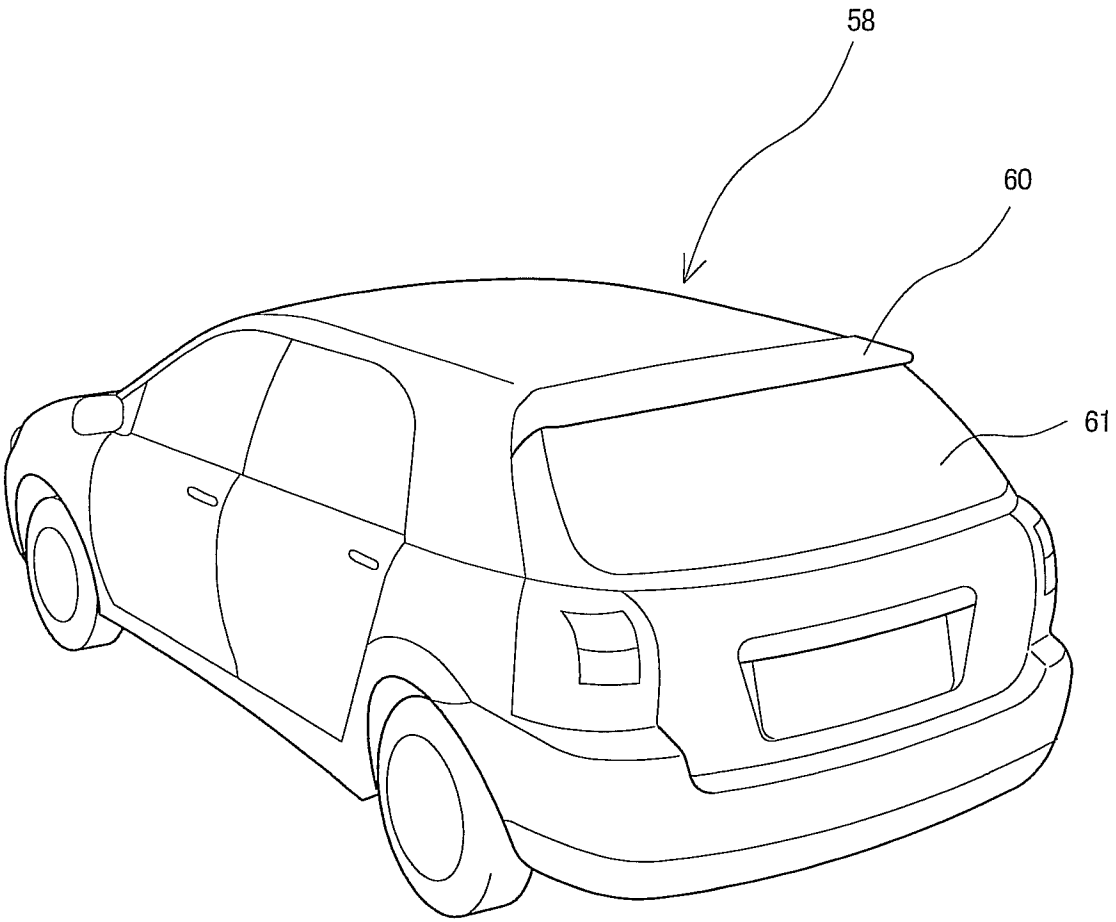
FIG. 7 shows a vehicle on which a spoiler antenna system is to be mounted.

FIG. 7 shows a vehicle 58 on which the spoiler antenna system is mounted. The spoiler 60 installed on this vehicle 58 is a hollow exterior component made of plastic resin or the like. The spoiler 60 shown in FIG. 7 is provided at the upper part of the rear window 61, and has a shape of a visor.

Figure 8:
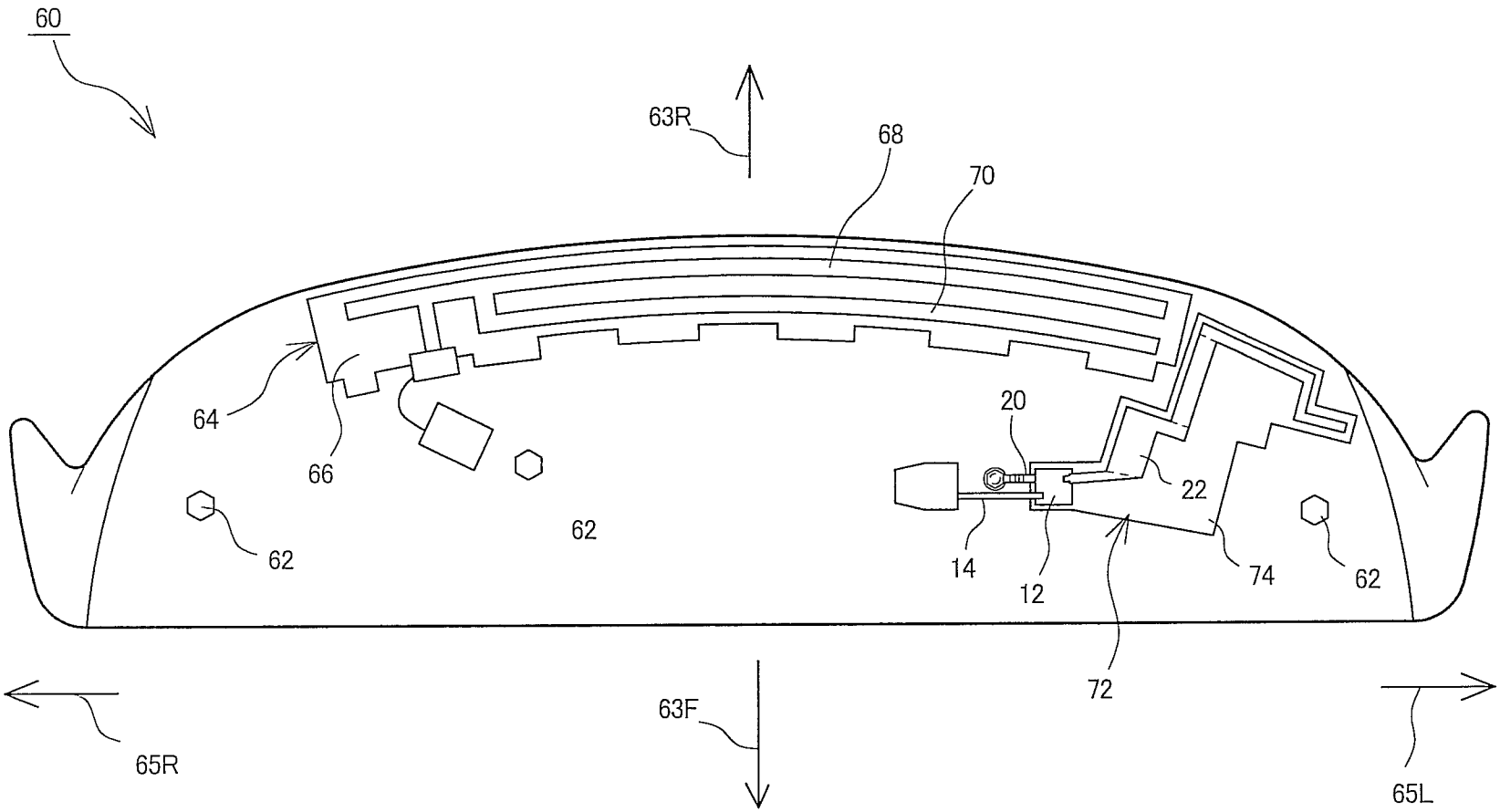
FIG. 8 shows a configuration of a spoiler antenna system according to an application example of the present invention.

FIG. 8 shows a configuration of the spoiler antenna system according to an application example of the present invention. It should be noted that FIG. 8 shows a view in which the top surface part of the casing of the spoiler 60 is removed. In FIG. 8, arrows 63F and 63R denote the forward and rear directions of the vehicle, respectively. Further, arrows 65R and 65L denote the right and left directions of the vehicle, respectively, when facing the forward direction. The spoiler 60 is fastened to the vehicle body by means of bolts 62 placed through the bolt holes provided in predetermined positions.

An AM/FM radio antenna 64 for receiving radio waves of AM radio broadcast and FM radio broadcast is arranged in the rear part of the spoiler 60. The AM/FM radio antenna 64 includes a resin antenna base 66 extending along the outer periphery of the rear part of the spoiler 60, and two antenna elements 68 and 70 arranged on the resin antenna base 66 in the same extending direction.

The vehicle-mounted DAB antenna 72 according to an embodiment of the present invention is provided toward the vehicle's left side from the AM/FM radio antenna 64. The vehicle-mounted DAB antenna 72 comprises a bent antenna element 22, a substrate 12 to which the bent antenna element 22 is connected, a resin antenna base 74 on which the bent antenna element 22 and the substrate 12 are arranged, a coaxial cable 14, and a grounding bracket 20. The bent antenna element 22 lies in bent form in a region not occupied by the AM/FM radio antenna 64. The resin antenna base 74 functions as an antenna base that supports the bent antenna element 22 and the substrate 12.

Figure 9:
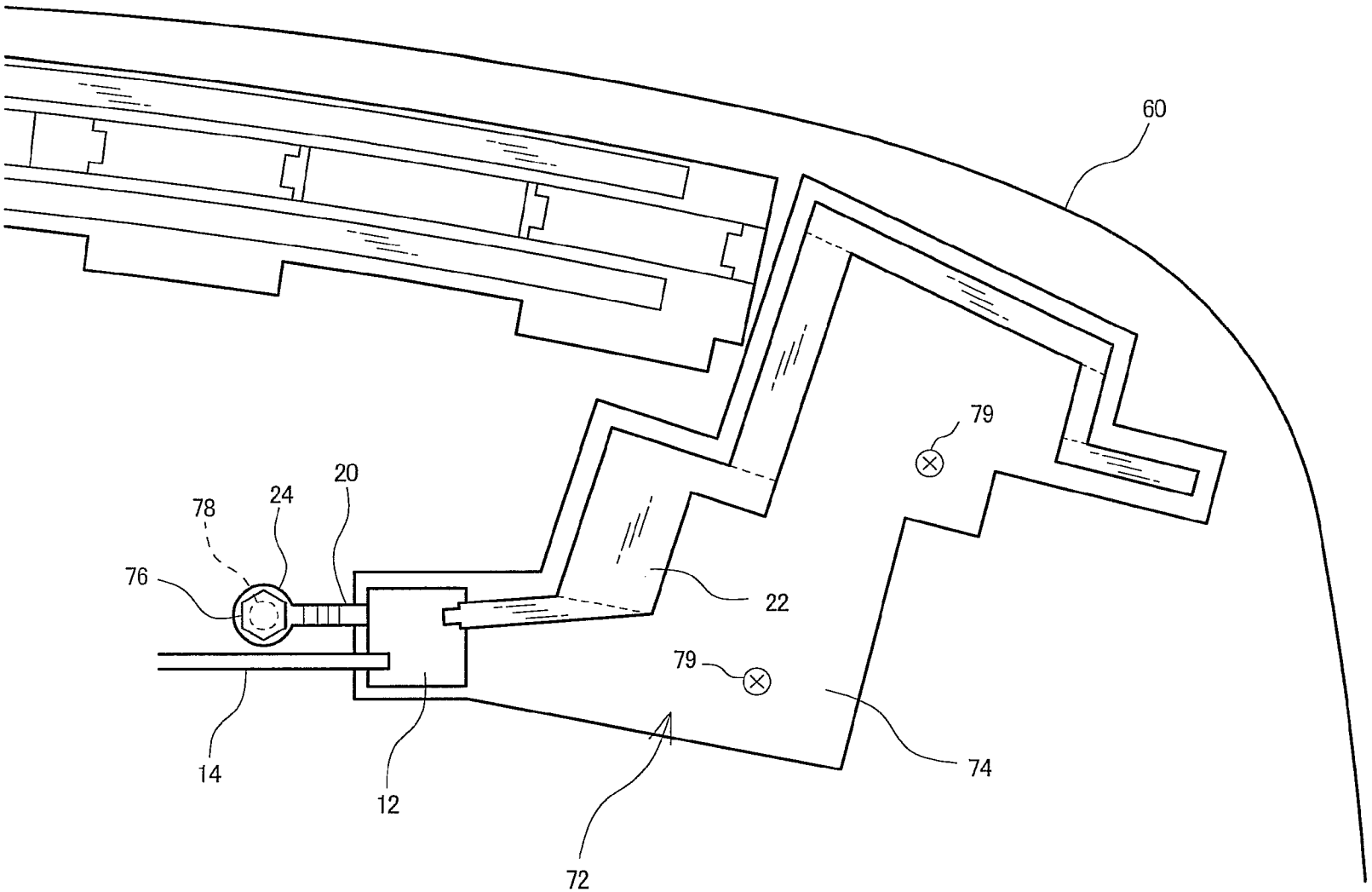
FIG. 9 shows a vehicle-mounted DAB antenna.

FIG. 9 is an enlarged view of the vehicle-mounted DAB antenna 72. The elements identical to those shown in FIGS. 2-6 are labeled with the same reference numerals, and explanations thereof are not repeated. The spoiler 60 has a bracket securing hole 78 formed therein to enable securing of the tip portion of the grounding bracket 20 to the vehicle body together with the spoiler 60 by means of a bolt 76.

The spoiler 60 is placed on the vehicle body, with the bracket securing hole 78 being aligned with the bolt hole of the vehicle body. In turn, the tip portion 24 of the grounding bracket 20 is placed with its bolt hole being aligned with the bracket securing hole 78 of the spoiler 60 and the bolt hole of the vehicle body. While in that state, the bolt 76 is placed through the bolt hole in the tip portion 24 of the grounding bracket 20 and the bracket securing hole 78, and is screwed into the bolt hole of the vehicle body, so that the grounding bracket 20 and the spoiler 60 are secured to the vehicle body. The resin antenna base 74 is fastened to the spoiler by means of screws 79. Accordingly, the substrate 12 and the bent antenna element 22 are secured to the spoiler 60 via the resin antenna base 74.

The DAB service frequency band includes a frequency band of 174 MHz to 240 MHz. When this band corresponds to the service frequency band, the grounding bracket 20 is configured to have an electrical length of approximately one twentieth of the wavelength, and a width of approximately one two-hundredth of the wavelength. Further, the plate capacitor 44 is configured to have a capacitance of approximately 15 pF.

With this arrangement, impedance between the outer conductor of the coaxial cable 14 and the vehicle body is reduced by the plate capacitor formed in the substrate 12, so that antenna performance becomes enhanced. Further, as it is possible to fasten the spoiler 60 to the vehicle body at the same time of connecting the tip portion 24 of the grounding bracket 20 to the vehicle body, structural simplification can be achieved.

Since the coefficient of thermal expansion differs between the spoiler 60 made mainly of plastic resin and the vehicle body made mainly of metal, there are cases in which the positional relationship of the bent antenna element 22 and the substrate 12 with respect to the bolt 76 is varied due to temperature changes. Even in such cases, as the grounding bracket 20 is formed in a belt shape and bent in a meandering manner, it is possible to avoid a large force from being applied to the joint portion between the grounding bracket 20 and the substrate 12. As such, when the grounding bracket 20 is soldered to the grounding conductor pattern of the substrate 12 as shown in FIGS. 4 and 5, breakage in the solder 51 can be prevented.

Similarly to the configuration shown in FIG. 6, it is alternatively possible to configure such that the bracket securing hole 78 is formed as a hole larger than the tip portion 24 of the grounding bracket 20, and the tip portion 24 of the grounding bracket 20 is secured directly to the vehicle body by means of the bolt 76.

Figure 10A:
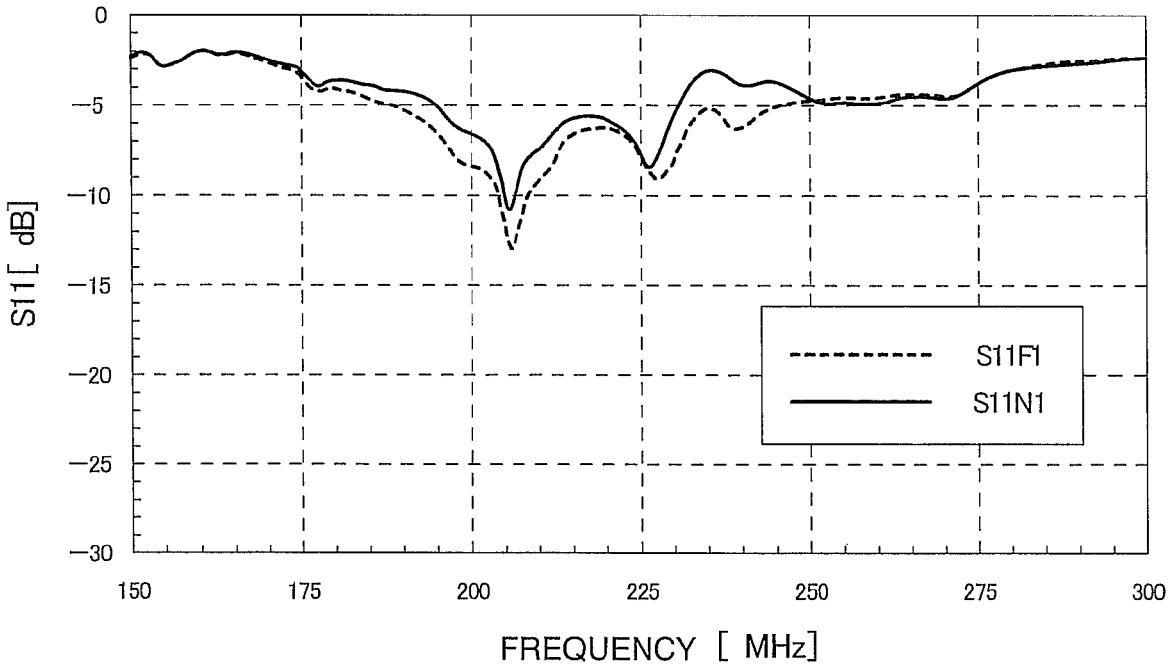
FIG. 10A shows experimental results concerning reflection coefficient characteristics.
Figure 10B:
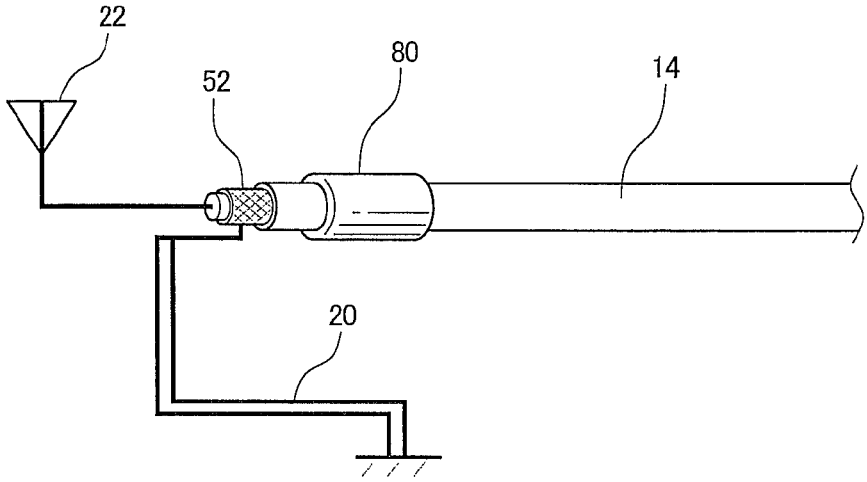
FIG. 10B shows a configuration of an antenna substrate unit.

Next, experimental results obtained using the vehicle-mounted antenna shown in FIGS. 2 and 4 are described. FIG. 10A shows reflection coefficient characteristics obtained when, at an end of the coaxial cable 14 connected to the bent antenna element 22, the outer conductor 52 of the coaxial cable 14 is grounded via the grounding bracket 20 as shown in FIG. 10B. In FIG. 10A, frequency is given on the horizontal axis, while refection coefficient S11 as viewed from the receiver side is given on the vertical axis. In this example, the plate capacitor 44 is not provided between the outer conductor 52 of the coaxial cable 14 and the grounding bracket 20. The characteristic denoted by "S11F1" in FIG. 10A is a characteristic obtained when a ferrite core 80 is provided around the coaxial cable 14 as shown in FIG. 10B. The characteristic denoted by "S11N1" is a characteristic obtained when such a ferrite core 80 is not provided.

As can be seen in FIG. 10A, in the case where the ferrite core 80 is provided; the reflection coefficient S11 is smaller and therefore the antenna performance is more favorable compared to when the ferrite core 80 is not provided. The reason for this is considered to be that, when the ferrite core 80 is not provided, a common mode current is generated in the outer conductor 52 of the coaxial cable 14 due to impedance of the grounding bracket 20, whereas the common mode current is suppressed when the ferrite core 80 is provided.

Figure 11A:
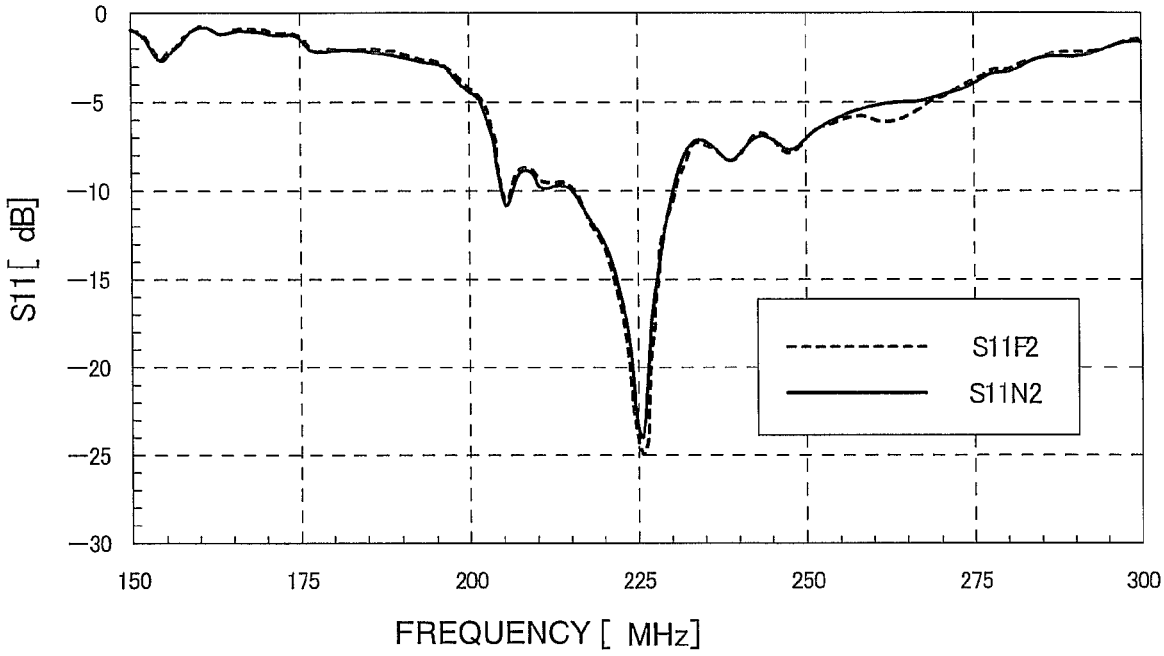
FIG. 11A shows experimental results concerning reflection coefficient characteristics.
Figure 11B:
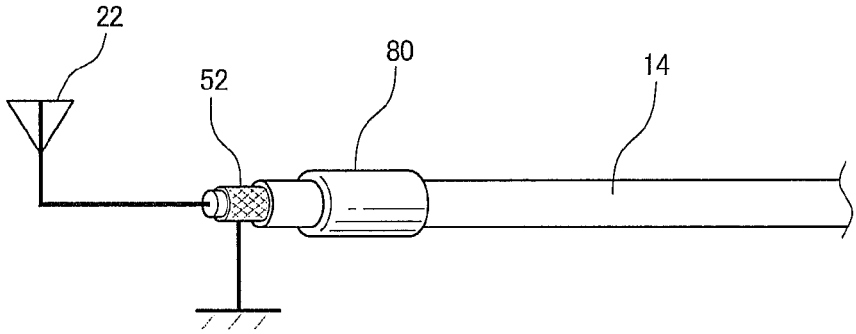
FIG. 11B shows a configuration of an antenna substrate unit.

FIG. 11A shows reflection coefficient characteristics obtained when, at an end of the coaxial cable 14 connected to the bent antenna element 22, the outer conductor 52 of the coaxial cable 14 is grounded directly as shown in FIG. 11B. In FIG. 11A, frequency is given on the horizontal axis, while refection coefficient S11 as viewed from the receiver side is given on the vertical axis. The characteristic denoted by "S11F2" in FIG. 11A is a characteristic obtained when a ferrite core 80 is provided around the coaxial cable 14 as shown in FIG. 11B. The characteristic denoted by "S11N2" is a characteristic obtained when such a ferrite core 80 is not provided.

Figure 12A:
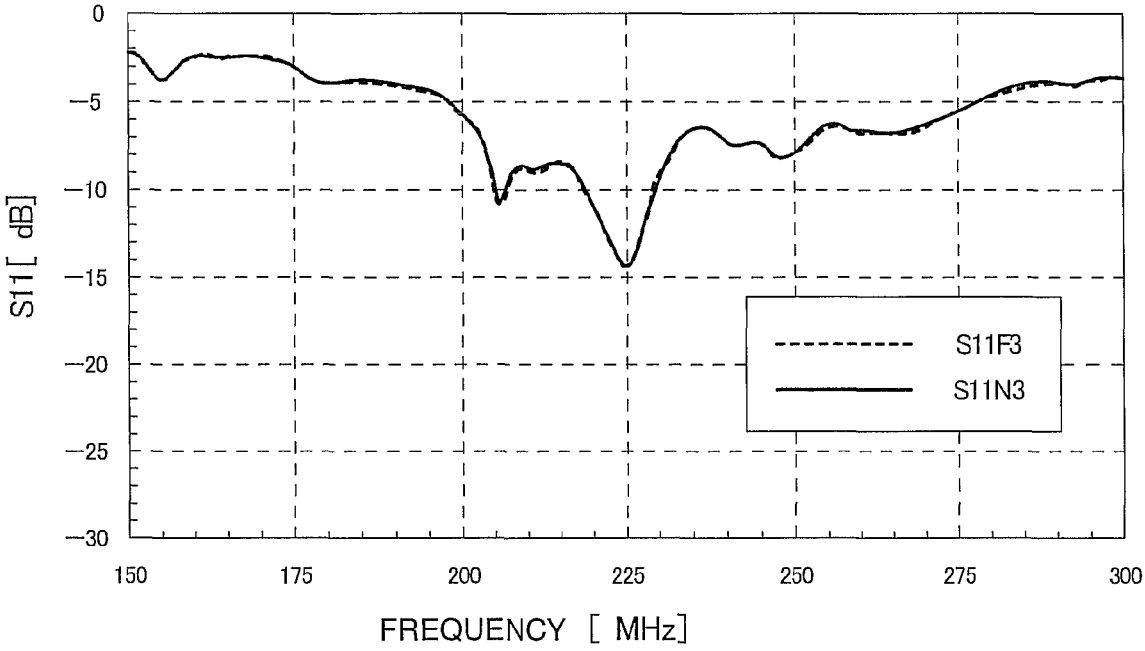
FIG. 12A shows experimental results concerning reflection coefficient characteristics.
Figure 12B:
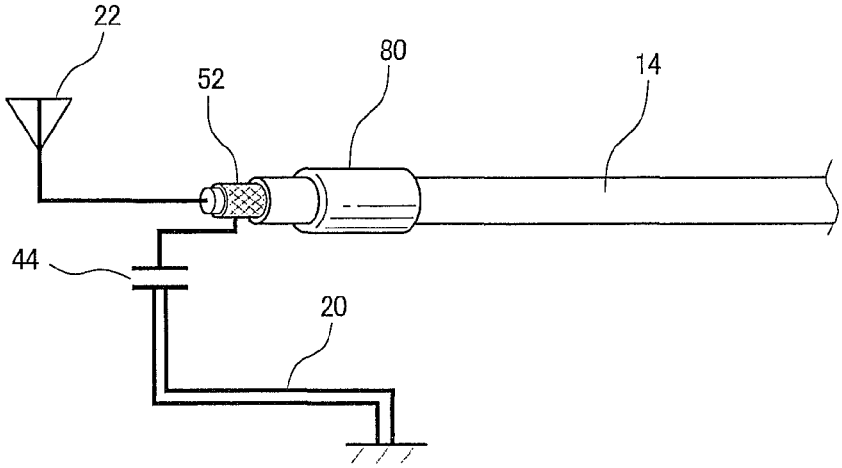
FIG. 12B shows a configuration of an antenna substrate unit.

FIG. 12A shows reflection coefficient characteristics obtained when, at an end of the coaxial cable 14 connected to the bent antenna element 22, the outer conductor 52 of the coaxial cable 14 is connected to a first end of the grounding bracket 20 via the plate capacitor 44, and the other end of the grounding bracket 20 is grounded, as shown in FIG. 12B. In FIG. 12A, frequency is given on the horizontal axis, while refection coefficient S11 as viewed from the receiver side is given on the vertical axis. The characteristic denoted by "S11F3" in FIG. 12A is a characteristic obtained when a ferrite core 80 is provided around the coaxial cable 14 as shown in FIG. 12B. The characteristic denoted by "S11N3" is a characteristic obtained when such a ferrite core 80 is not provided.

In each of FIGS. 11A and 12A, the difference between the characteristics obtained with and without the ferrite core 80 is smaller than in FIG. 10A. The reason for this is considered to be that, in each of these examples, impedance between the outer conductor 52 of the coaxial cable 14 and the grounding conductor is small so that a common mode current that flows through the outer conductor 52 of the coaxial cable 14 is suppressed, such that the effect of the ferrite core 80 does not become apparent.

Specifically, in the example according to FIGS. 11A and 11B, by grounding the outer conductor 52 directly, impedance between the outer conductor 52 and the grounding conductor is reduced. Meanwhile, in the example according to FIGS. 12A and 12B, it is considered that impedance between the outer conductor 52 and the grounding conductor is reduced by grounding the outer conductor 52 via the plate capacitor 44 and the grounding bracket 20.

The invention claimed is:

1. A vehicle-mounted antenna substrate unit, comprising:

a substrate having an antenna element connected thereto and including a grounding conductor plate;

a linear conductor drawn out from the substrate and at least partly secured to a conductor component of a vehicle; and a capacitor provided between the grounding conductor plate and the linear conductor.

2. The vehicle-mounted antenna substrate unit defined in claim 1, wherein the capacitor comprises the grounding conductor plate and a further layer conductor plate provided in a layer different from a layer in which the grounding conductor plate is provided; and the linear conductor is connected to the further layer conductor plate.

3. The vehicle-mounted antenna substrate unit defined in claim 1, further comprising:

a cable drawn out from the substrate; and an impedance matching circuit provided on the substrate and between the antenna element and the cable;

wherein the impedance matching circuit comprises the capacitor.

4. The vehicle-mounted antenna substrate unit defined in claim 3, wherein the capacitor comprises the grounding conductor plate and a further layer conductor plate provided in a layer different from a layer in which the grounding conductor plate is provided; and the linear conductor is connected to the further layer conductor plate.

5. The vehicle-mounted antenna substrate unit defined in claim 1, wherein the linear conductor is formed to have a belt shape, and has a tip portion secured to the vehicle.

6. The vehicle-mounted antenna substrate unit defined in claim 5, further comprising an antenna base on which the substrate and the linear conductor are arranged, wherein the antenna base is secured to an exterior component of the vehicle.

7. The vehicle-mounted antenna substrate unit defined in claim 6, wherein the conductor component is a body of the vehicle, and the exterior component is a spoiler.

8. The vehicle-mounted antenna substrate unit defined in claim 1, wherein the conductor component is a body of the vehicle, the substrate and the linear conductor are provided on a non-conductive exterior component of the vehicle, and the linear conductor is secured to the vehicle body together with the exterior component by means of a member that fastens the exterior component to the vehicle body.

9. The vehicle-mounted antenna substrate unit defined in claim 8, wherein the exterior component is a spoiler.

* * * * *